US005647569A

United States Patent [19]

Sofy

[11] Patent Number: 5,647,569

[45] Date of Patent: Jul. 15, 1997

[54] ROTATING CHRISTMAS TREE STAND

[75] Inventor: Hugh M. Sofy, Troy, Mich.

[73] Assignee: HMS, Mfg. Co., Troy, Mich.

[21] Appl. No.: 575,383

[22] Filed: Dec. 20, 1995

[51] Int. Cl.[6] ..... F16M 13/00

[52] U.S. Cl. ..... 248/522

[58] Field of Search ..... 248/522, 521, 248/523, 519, 349.1, 550, 131; 211/1.52, 1.53

[56] References Cited

U.S. PATENT DOCUMENTS

| | | | |
|---|---|---|---|
| 1,219,892 | 3/1917 | Witt . | |
| 1,971,300 | 8/1934 | Garrett . | |
| 1,988,343 | 1/1935 | Tacy . | |
| 2,492,241 | 12/1949 | Schillinger . | |
| 2,527,969 | 10/1950 | Siebenkittel | 248/522 X |
| 2,568,995 | 9/1951 | Eckhardt, Jr. . | |
| 2,587,788 | 3/1952 | Tacy . | |
| 2,825,255 | 3/1958 | Kuehni et al. . | |
| 2,847,175 | 8/1958 | Farley et al. . | |
| 2,956,357 | 10/1960 | Rakes . | |
| 3,042,350 | 7/1962 | Lencioni | 248/522 |
| 3,324,289 | 6/1967 | Cirko . | |
| 3,555,704 | 1/1971 | Schrumpf et al. . | |
| 4,890,008 | 12/1989 | Chu | 248/522 X |
| 5,190,261 | 3/1993 | Tetting | 248/522 |
| 5,255,886 | 10/1993 | Wang | 248/522 |
| 5,467,959 | 11/1995 | Behringer | 248/523 |

*Primary Examiner*—Ramon O. Ramirez
*Attorney, Agent, or Firm*—Howard & Howard

[57] ABSTRACT

A rotating stand assembly (10) for a stemmed article such as a Christmas tree (24) or a merchandise display rack includes a base (12), a spindle (18), bearings (36, 38) interconnecting the base (12) and the spindle (18). An electric motor (46) drives the spindle (18) through a gear train. A clutch (58) automatically disconnects the motor (46) from the spindle (18) in response to a predetermined force applied to the spindle. The clutch (58) includes a compression spring (78) for establishing the predetermined force required to disconnect the motor (46) from the spindle (18). Snap-fit outlets (86) are located in a top cover (32) of the spindle (18). The outlets (86) are electrically connected to contact rings (90, 92) without solder. A limit switch (84) can provide and audible warning that there is an obstruction to normal operation. A live tree adapter (106) is placed into the spindle (18) to accommodate a live Christmas tree (24).

27 Claims, 8 Drawing Sheets

4

18
26
88
28
86
86
88
92
32
90
4

48
19
44
46
50
52

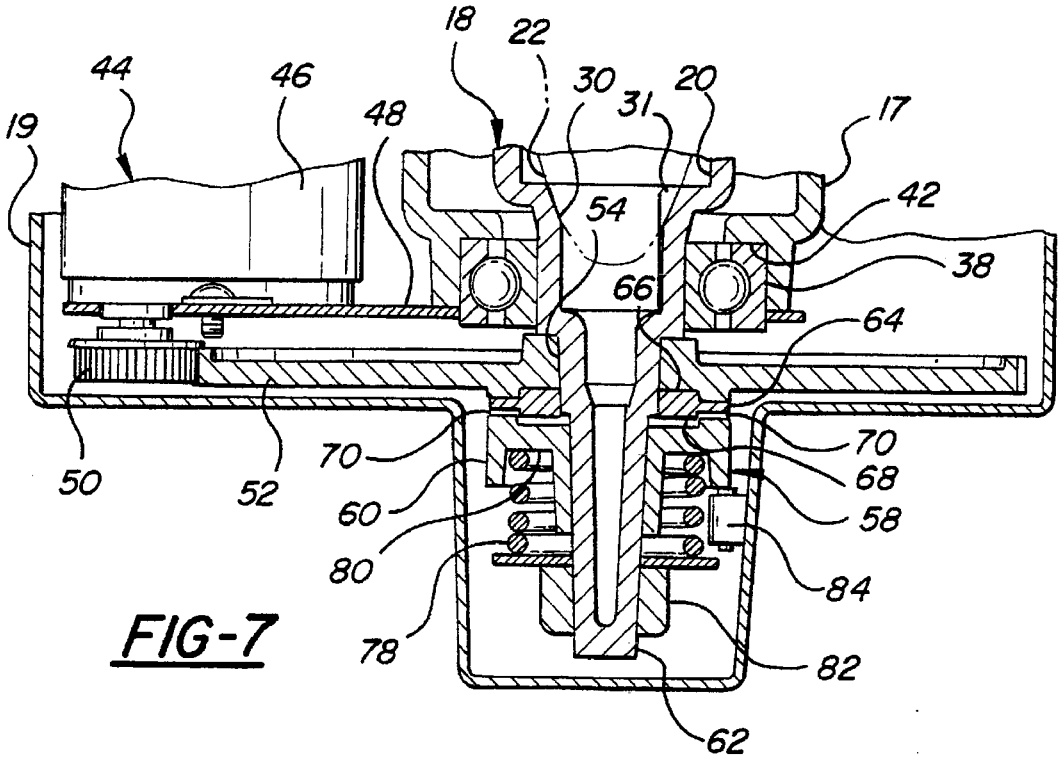
FIG-7
FIG-8
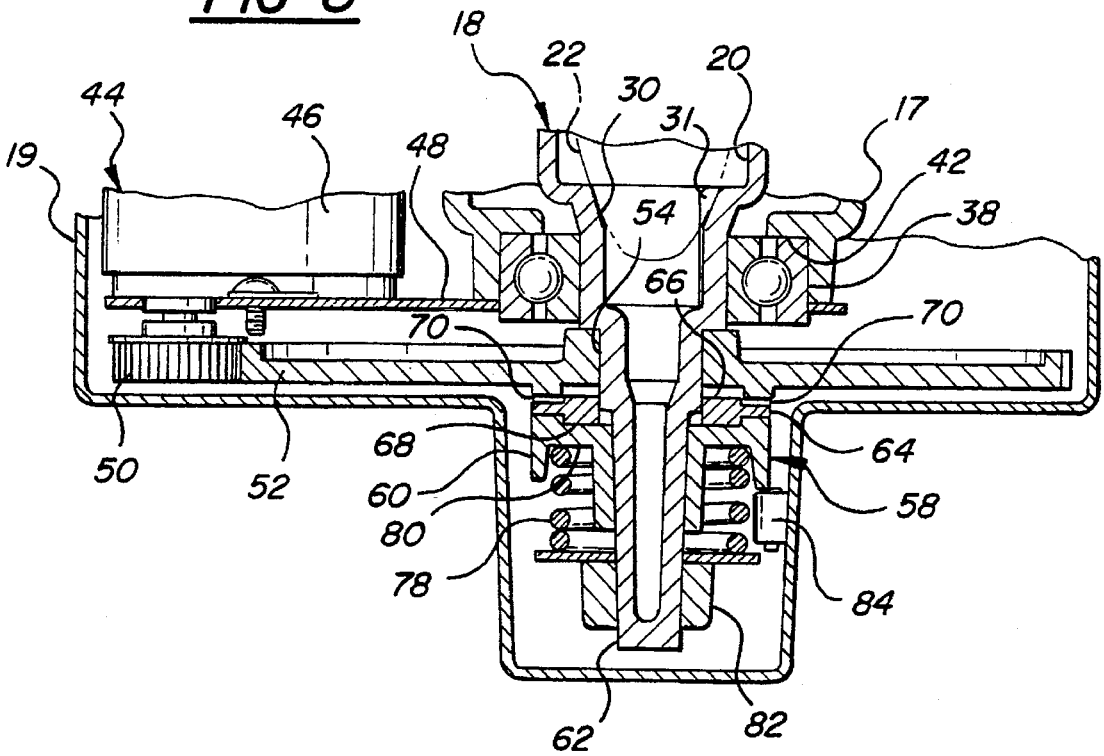

ROTATING CHRISTMAS TREE STAND

TECHNICAL FIELD

This invention relates to a motorized rotating display stand for a stemmed article such as a Christmas tree or a merchandise rack or the like. More specifically, the subject invention is directed toward such a rotating display stand having an improved clutch mechanism to prevent motor damage in the event of obstruction or mishandling.

BACKGROUND OF THE INVENTION

For decorative and holiday (e.g., Christmas) purposes it is frequently desirable to display a fresh cut or artificial evergreen tree in a natural upstanding posture. A portable tree stand is used to support the tree in this manner. Likewise, for marketing and retail selling purposes a stemmed merchandise rack is mounted in a display stand. The display stand may be motorized to rotate the Christmas tree or merchandise rack to draw attention and enhance aesthetic appeal.

When stemmed articles, such as Christmas trees and merchandise racks, are rotated in a motorized stand, it is foreseeable that an obstruction may occur and prevent the article from rotating. Both in the case of Christmas trees and merchandise display racks, it is also foreseeable that the obstruction may go unnoticed for a long period of time, during which the motor continues operating. In addition, both Christmas trees and merchandise racks in rotating display stands are susceptible to mischievous mishandling. For example, children may attempt to forcibly rotate the tree while the motor is operating, thus placing severe adverse loads on the motor. Furthermore, when a Christmas tree or merchandise rack in rotating display stand is not powered for rotation, i.e., when the rotating stand is turned off, forced rotation of the tree or rack can place harmful stresses on the motor, gear train, and other components in the tree stand.

The prior art teaches two possible solutions to these potentially damaging occurrences. One such solution is to size the motor so that it is capable of weathering long term obstructions and mischievous mishandling. This option, however, is generally disfavored due to the substantial increase in cost for a heavy duty motor. The second solution is to install a clutch between the motor and the rotating spindle. For example, U.S. Pat. No. 1,988,343 to Tacy, issued Mar. 29, 1932, and U.S. Pat. No. 2,587,788 also to Tacy, issued Mar. 4, 1952 both disclose simple friction clutch designs which permit slippage between the rotating spindle and the motor in the event of an obstruction. Such friction clutch designs represent a poor design choice in that the point of clutch disengagement cannot be established with certainty. While the clutch of one display stand may disengage at a 10 pound resistance, another identical display stand may not disengage until a 30 pound resistance is applied. Also, the break point cannot be maintained with certainty over long periods of time, and the clutch mechanism itself is prone to rapid attrition.

U.S. Pat. No. 3,042,350 to Lencioni, issued Jul. 3, 1962, discloses a cleat-type clutch where the bottom of the spindle is fitted with a series of female grooves and a driven gear is provided with a male cleat which seats in the female grooves. If an obstruction prevents the Christmas tree from rotating with the motor, the female grooves on the spindle will ride up and over the cleat. While this cleat-type design is an improvement over the earlier friction clutch design, it is still not possible to predict with certainty the point of clutch disengagement. In the Lencioni design, the weight of the Christmas tree provides the normal force to compress the female grooves over the male cleat and resist disengagement of the clutch. If the Christmas tree is particularly heavy, a greater resistance will be required to disengage the clutch. Conversely, if the Christmas tree is particularly light, it may not provide enough normal (compressive) force to overcome inertia at start-up.

SUMMARY OF THE INVENTION AND ADVANTAGES

The subject invention comprises a rotating stand assembly for a stemmed article such as a Christmas tree or a merchandise rack. The assembly includes a base and, a spindle disposed within the base. The spindle includes a receptacle for receiving and holding a stem in an upright posture. A bearing means rotatably supports the spindle within the base. A motor means forcibly rotates the spindle within the base. A clutch means automatically disconnects the motor from the spindle in response to a predetermined force applied to the spindle. The invention is characterized by the clutch means including a spring means for establishing the predetermined force required to disconnect the motor from the spindle.

The subject invention overcomes the disadvantages of the prior art by providing a spring means in the clutch means to establish and maintain a consistent point of disengagement for the clutch regardless of the weight of the stemmed article and regardless of the frictional fit between the motor means and the spindle. In this manner, the subject invention is rendered more durable and safer than the prior art.

BRIEF DESCRIPTION OF THE DRAWINGS

Other advantages of the present invention will be readily appreciated as the same becomes better understood by reference to the following detailed description when considered in connection with the accompanying drawings wherein:

FIG. 7 is a fragmentary cross-sectional view showing the clutch means in the disengaged condition occurring when an obstruction prevents the Christmas tree or other stemmed article from rotating;

FIG. 8 is fragmentary cross-sectional view as is FIG. 7 but showing the clutch means in the disengaged condition occurring when the Christmas tree or other stemmed article is forcibly rotated;

DETAILED DESCRIPTION OF THE PREFERRED EMBODIMENT

Figure 1:
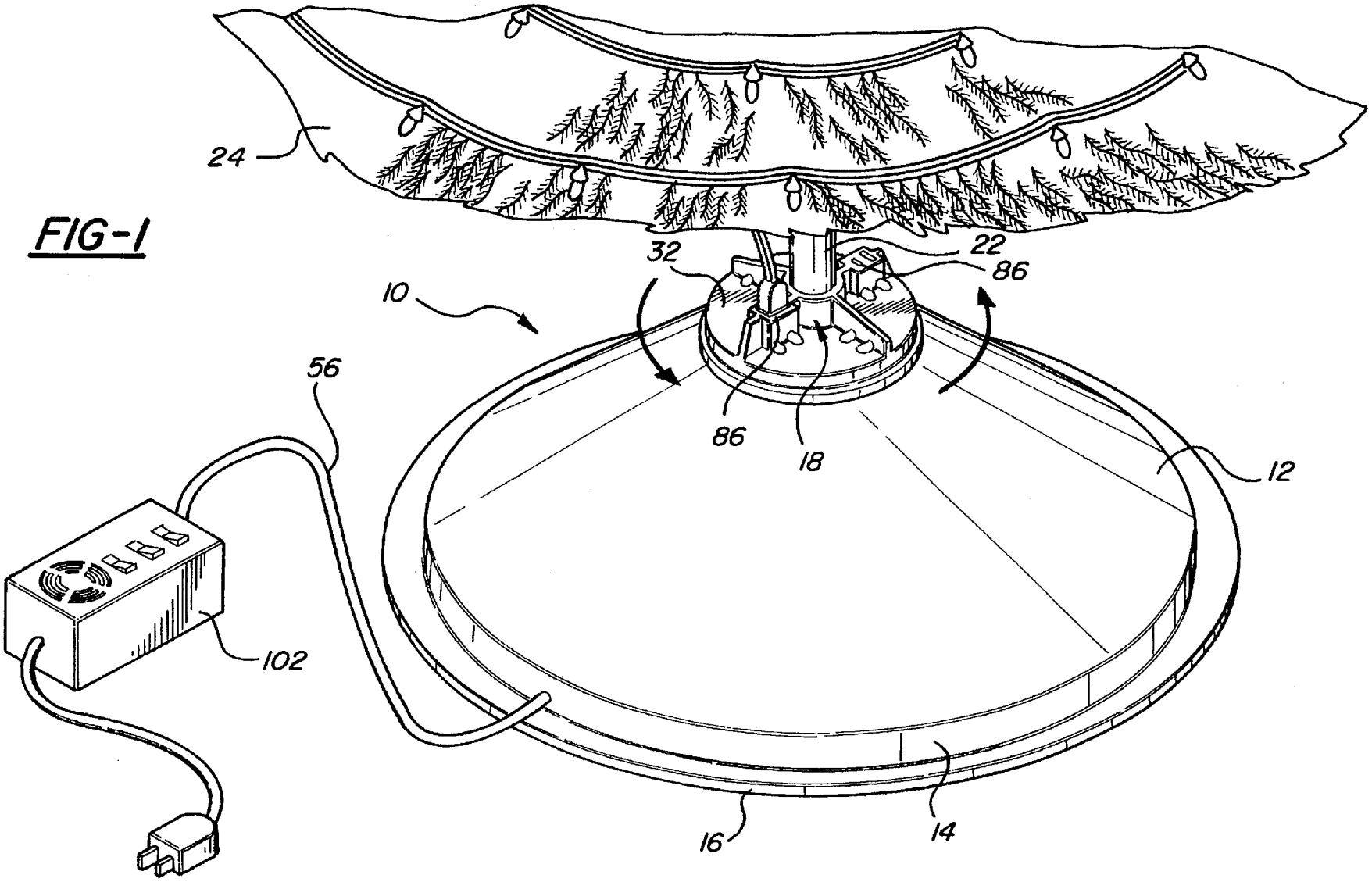
FIG.1 is a perspective view showing the subject display stand assembly supporting an artificial Christmas tree.

Referring to the Figures, wherein like numerals reference like or corresponding parts throughout the several views, a rotating display stand assembly according to the subject invention is generally shown at 10. The rotating stand assembly 10 is of the type for supporting a stemmed article such as a Christmas tree or a merchandise display rack. The assembly 10 comprises a base 12 having a generally frustoconical shape with a lower cylindrical leg 14 and peripheral flange 16. An internal sleeve 17 is formed integrally within the base 12. In the preferred embodiment, the base 12 is fabricated from a thin wall injection molded plastic material. The interior of the base 12 is spacious to house the mechanical and electrical components described below. A thin-walled sheet metal inner guard 19 is fastened inside the base 12 with screws to enclose the mechanical and electrical components.

Figure 2:
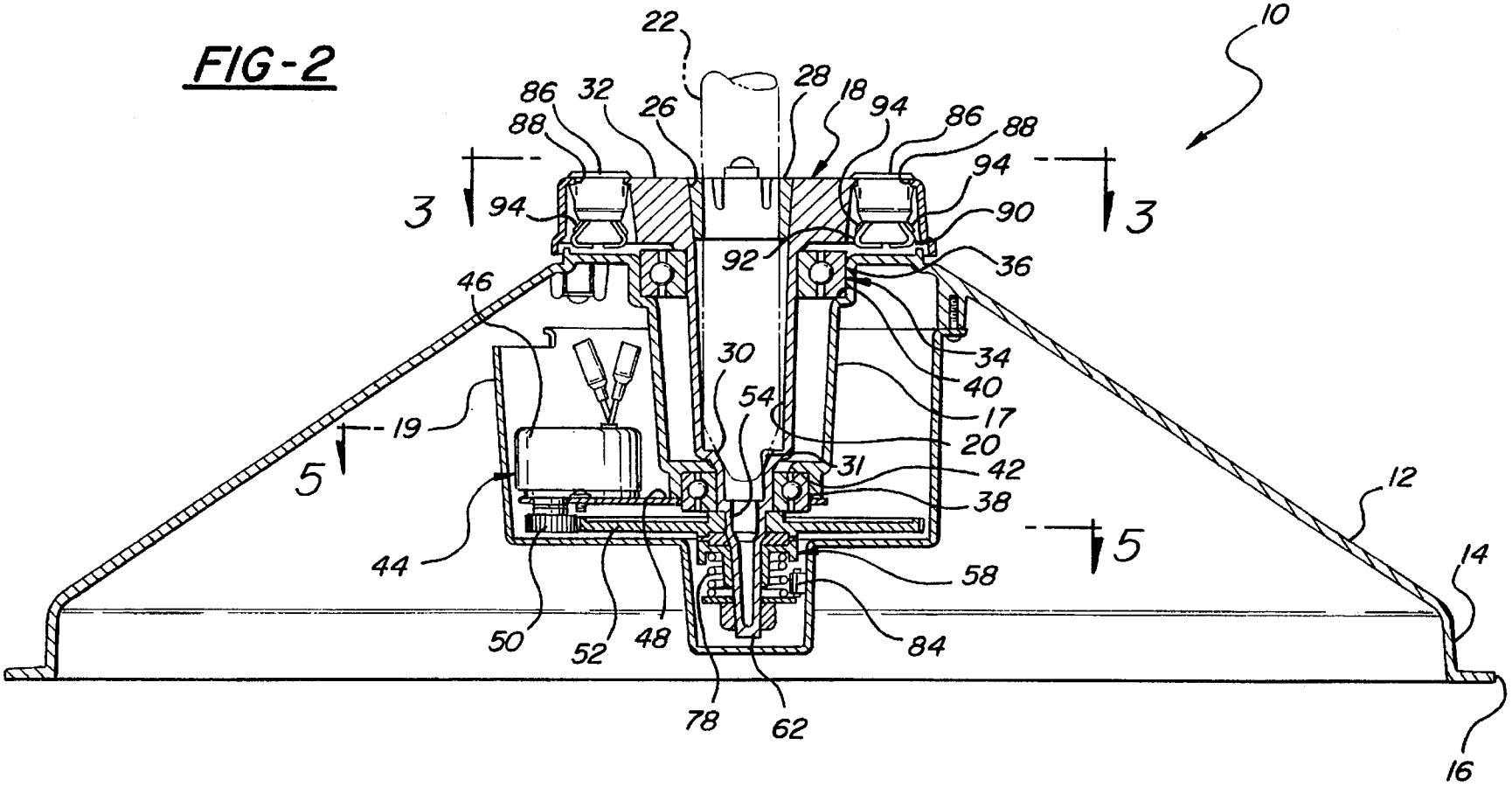
FIG. 2 is a cross-sectional view of the display stand assembly.
Figure 3:
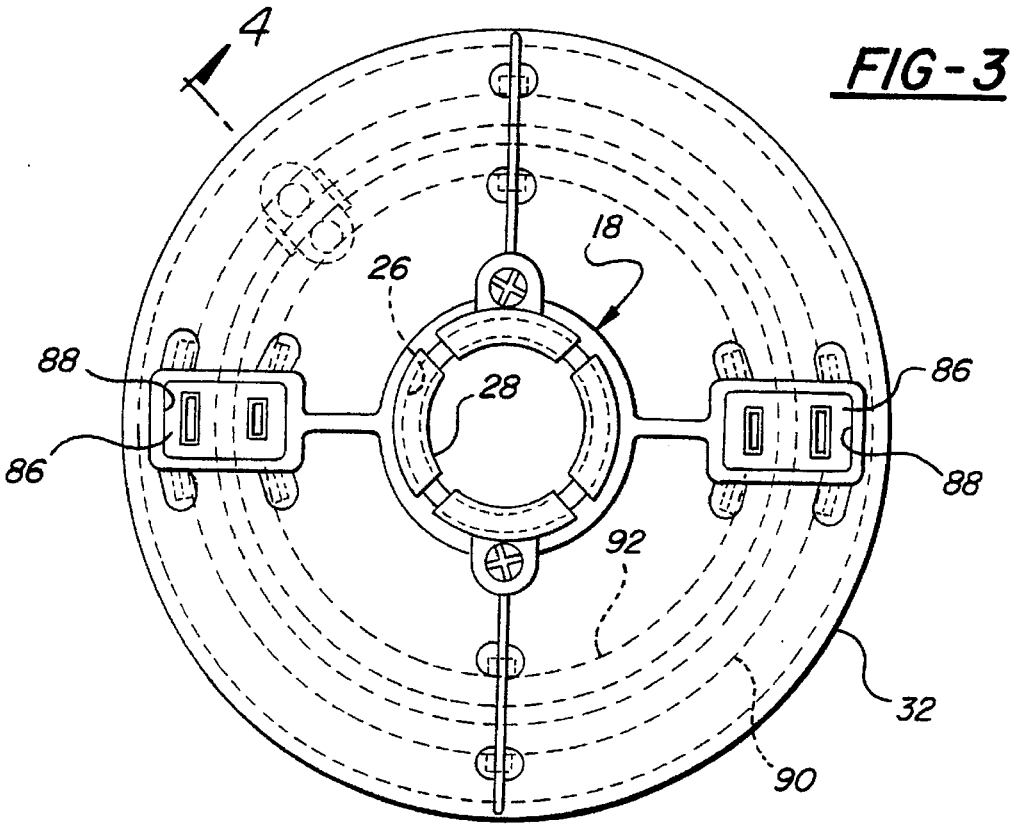
FIG. 3 is a fragmentary top view of the display stand assembly taken from lines 3—3 in FIG. 2.
Figure 4:
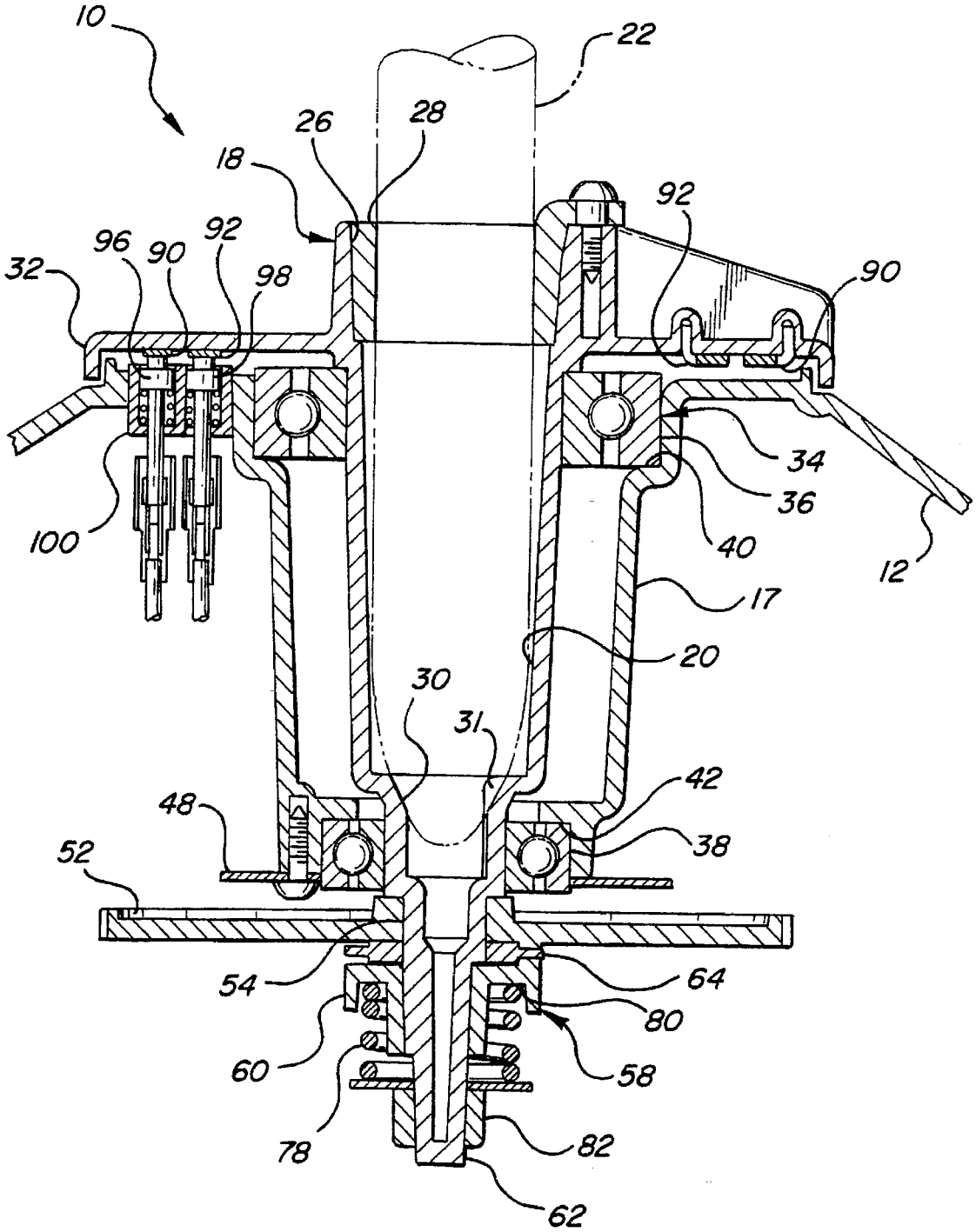
FIG. 4 is a cross-sectional-view of the display stand assembly taken along lines 4—4 in FIG. 3.
Figure 6:
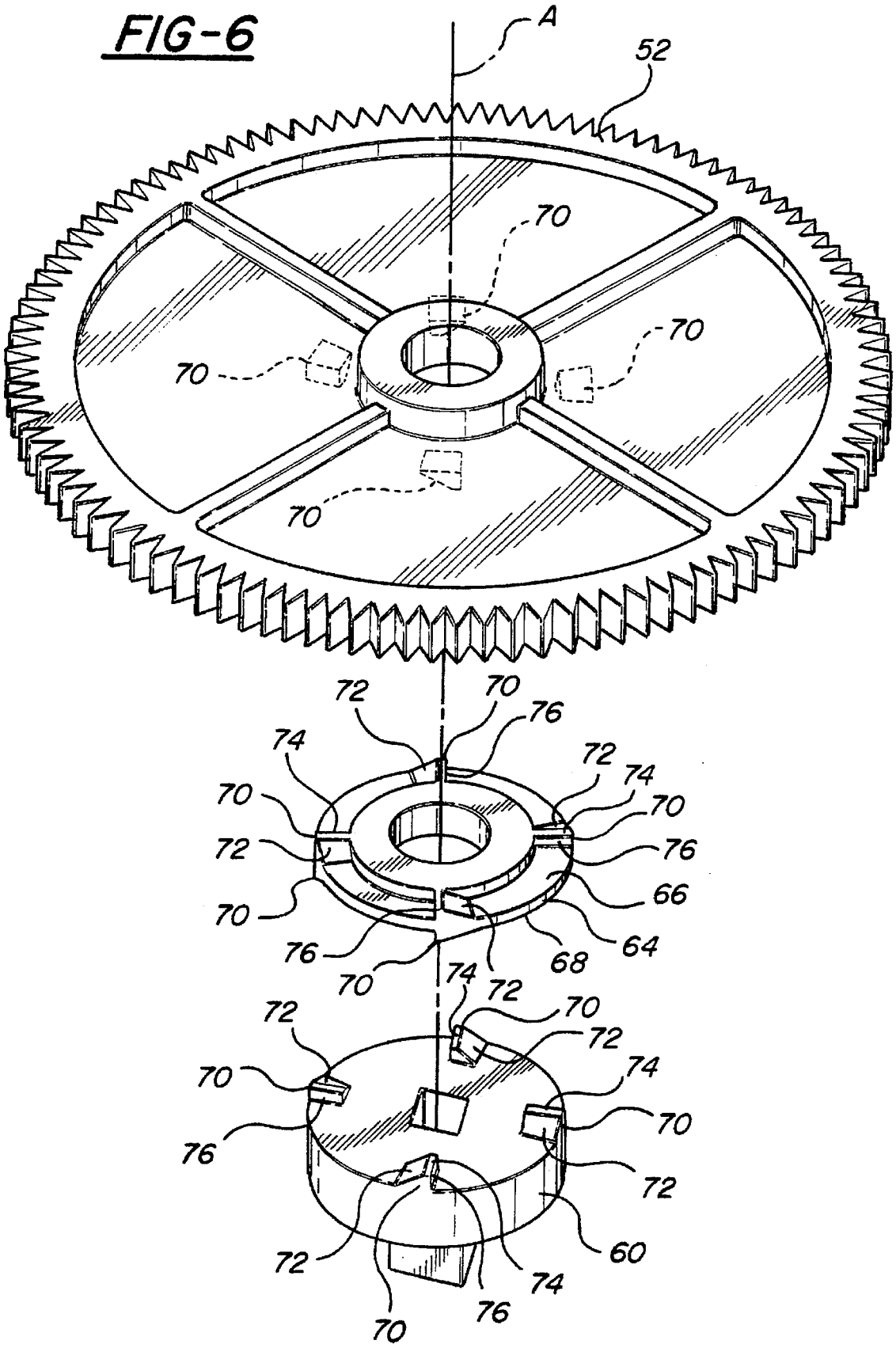
FIG. 6 is an exploded view of the clutch means.

A spindle, generally indicated at 18 in FIGS. 2 and 4, is disposed within the base 12. The spindle 18 is rotatably supported in the base 12 for rotation about a vertical central axis A. The spindle 18 includes a center receptacle 20 for receiving and holding the stem 22 of an article such as a Christmas tree 24 or a merchandise display rack (not shown) in an upright posture. In the preferred embodiment, the spindle 18 is made of an injection molded plastic. The upper portion of the receptacle 20 includes a seat 26 for receiving a stem-gripping collet 28. The receptacle 20 tapers to an internal shoulder or constriction 30 which centers the pointed tip of the stem 22. A top cover 32 extends outwardly from the uppermost end of the spindle 18, covering a portion of the base 12. A rib 31 may extend inwardly from the constriction 30 to provide an interlock with any crimped indentations (not shown) in the pointed tip of the stem 22, thereby positively preventing slippage between the stem 22 and the spindle 18.

Bearing means, generally indicated at 34 in FIGS. 2, 4, 7 and 8, rotatably supports the spindle 18 within the base 12. The bearing means 34 comprises an upper thrust beating 36 and a lower radial load bearing 38. Both of these bearings 36, 38 utilize hardened steel races and rollers to maintain a dependably low coefficient of friction over the life of the assembly 10. The upper thrust beating 36 is press fit into an upper pocket 40 in the sleeve 17 of the base 12. Likewise, the lower radial load bearing 38 is press fit into a lower pocket 42. The beatings 36, 38 can be press fit into the respective pockets 40, 42 shortly after the base 12 is injection molded, while the plastic is still warm, so that the outer bearing races will be tightly griped as the plastic shrinks. The inner races of both bearings 36, 38 fit snugly around the spindle 18, and the upper thrust bearing 36 abuts against a shoulder of the spindle 18 to support the thrust loads.

Figure 5:
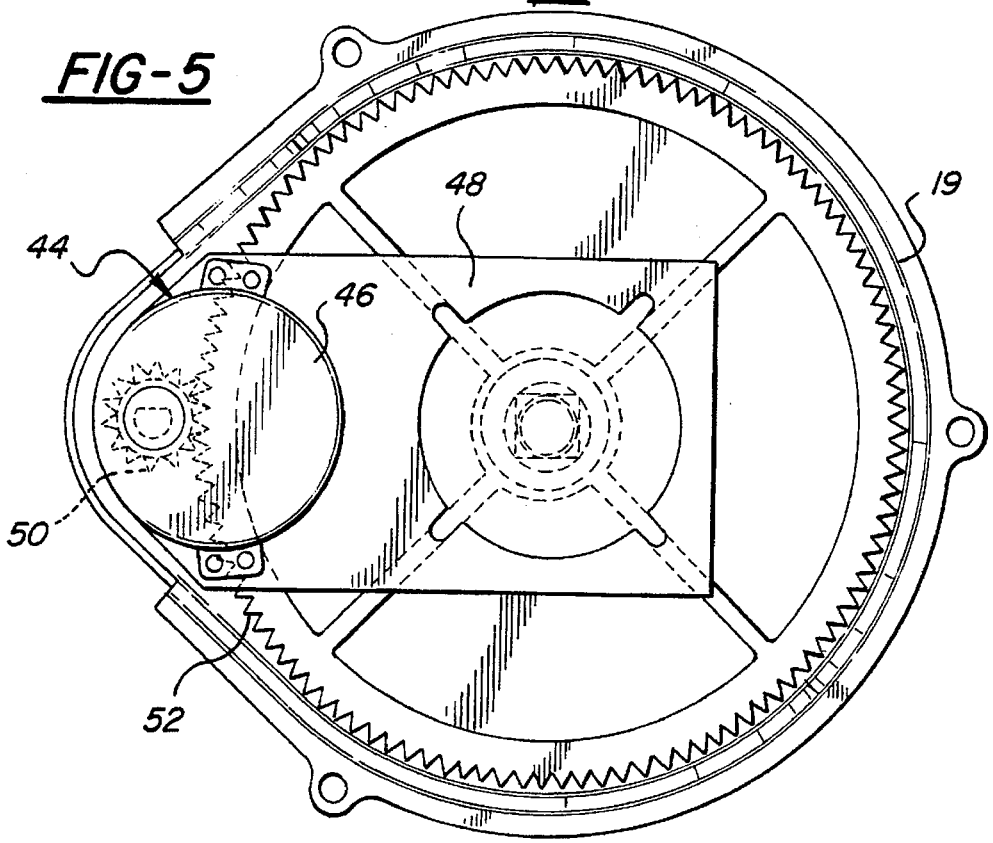
FIG. 5 is a cross-sectional view of the motor means taken along lines 5—5 of FIG. 2.

Motor means, generally indicated at 44 in FIGS. 2, 4 and 5, forcibly rotates the spindle 18 within the base 12. Preferably, the motor means 44 comprises an electric motor 46 mounted inside the base 12 upon a mounting plate 48. The mounting plate 48 is secured by screws to the bottom edge of the sleeve 17. A driver pinion 50 is attached to the output shaft of the electric motor 46. The driver pinion is preferably of the spur gear type, although alternative gear types are possible. The drive pinion 50 meshes with a driven gear 52 which is rotatably disposed about a cylindrical shank portion 54 of the spindle 18. That is, the driven gear 52 has a center mounting hole which is slightly larger than the outer diameter of the cylindrical shank portion 54. A power cord 56 extends from electric motor 46 exteriorly of the base 12.

A clutch means, generally indicated at 58 in FIGS. 2, 4, and 6–8, automatically disconnects the electric motor 46 from the spindle 18 in response to a predetermined force applied to the spindle 18. That is, when an obstruction prevents the Christmas tree 24 or other stemmed article from rotating while the motor is running, or when the Christmas tree 24 is forcibly rotated while the motor is not running, the clutch means 58 will disengage the electric motor 46 to prevent damage to the motor 46 and the gear train. The clutch means 58 includes a spring cage 60 fixedly connected to the lowermost end 62 of the spindle 18. The spring cage 60 is provided with a square center hole. The lowermost end 62 of the spindle 18, which is also square, passes freely through the square hole in the spring cage 60 to allow sliding movement between the two members yet provide a keyed drive connection. Of course, other polygonal shapes, splines or the like could be used instead of the square profiles.

An intermediate clutch ring 64 is freely rotatably disposed about the shank portion 54 of the spindle 18. The clutch ring 64 operatively engages both the spring cage 60 and the driven gear 52. In this manner, the electric motor 46 rotates the driven gear 52, which in turn transmits driving rotary motion to the spring cage 60 through the clutch ring 64. The spindle 18 is then rotated via the keyed drive connection to the spring cage 60. The clutch ring 64 includes an upper side 66 disposed adjacent the driven gear 52 and a lower side 68 adjacent the spring cage 60.

Opposing cleats 70 are arranged between the bottom of the driven gear 52 and the upper side 66 of the clutch ring 64, and also between the lower side 68 of the clutch ring 64 and the top of the spring cage 60. In the preferred embodiment, perhaps best illustrated in FIG. 6, a circular series of four cleats 70 are disposed on each of the abutting surfaces. Each cleat 70 includes a ramping surface 72, a land 74, and a perpendicular stop face 76. The perpendicular stop face 76 of each of cleat 70 is disposed in a plane radiating from the central axis A. The cleats 70 are arranged so that the stop faces 76 of the cleats 70 on the upper side 66 of the clutch ring 64 will abut and engage the stop faces 76 of the cleats 70 on the bottom of the driven gear 52, and likewise so that the stop faces 76 of the cleats 70 on the lower side 68 of the clutch ring 64 will abut and engage the stop faces 76 of the cleats 70 on the top of the spring cage 60. According to this arrangement, the respective ramping surfaces 72 of the opposing cleats 70 are also poised to engage and react against each other under certain conditions described below. The ramping surfaces 72 of the cleats 70 on the upper side 66 and on the lower side 68 of the clutch ring 64 extend from their respective stop faces 76 in a common direction, i.e., in a counter clockwise direction about the central axis A.

A spring means is provided for establishing and maintaining the predetermined force required to disconnect the motor 46 from the spindle 18. Preferably, the spring means comprises a helical compression spring 78 contained over the shank 54 portion and lowermost end 62 of the spindle 18. The upper end of the spring 78 is captured within an annular recess 80 of the spring cage 60, and the lower end of the spring 78 abuts a retainer 82. As shown in the figures, the retainer 82 may comprise a typical nut and washer combination threaded directly onto the lowermost end 62 of the spindle 18. The degree to which the retainer nut 82 is tightened will affect the compression of the spring 78, which can be set at the factory for optimum performance.

Referring now to FIGS. 7 and 8, the operation of the clutch means 58 will be described in greater detail. There exist two circumstances under which damage may result to the electric motor 46 and/or gear train. An obstruction may occur and prevent the Christmas tree 24 (or other stemmed article) from rotating, during which the motor continues operating. This may go unnoticed for a long period of time.

Or, someone may purposely attempt to rotate the tree while the motor is running or stopped. Both of these conditions could cause serious damage to the assembly 10 but for the clutch means 58.

In FIG. 7, the illustrated positions of the clutch ring 64 and spring cage 60 are representative of the condition which occurs when either the motor 46 is running and an obstruction prevents rotation of the tree 24, or when the motor 46 is stopped but someone forcibly twists the tree 24 in a reverse direction. Under these circumstances, the stop faces 76 of the cleats 70 on the bottom of the driven gear 52 and the upper side 66 of the clutch ring 64 squarely abut one another, causing the clutch ring 64 to continue rotating with the motor 46 and driven gear 52. However, the ramping surfaces 72 of the cleats 70 on the lower side 68 of the clutch ring 64 and on the top of the spring cage 60 are brought into contact with each other, forcing the spring cage 60 downwardly along the spindle 18. As the opposing lands 74 slide past one another, the spring 78 very positively forces the spring cage upwardly again, causing the top of the spring cage 60 to violently collide with the lower side of the clutch ring 64. This collision results in a loud report, repeated every quarter turn of the clutch ring 64, which alerts of the obstruction or mischievous mishandling. The sound is enhanced and made more vexatious by the profile of the cleats 70, where the stop faces 76 are perpendicular thus allowing a very rapid collision as the opposing lands 74 clear one another.

In FIG. 8, the illustrated positions of the clutch ring 64 and spring cage 60 are representative of the condition which occurs when either the motor 46 is turning and someone forcibly twists the tree 24 in a forward direction, or when the motor 46 is stopped and someone forcibly twists the tree 24 in a forward direction. Under these circumstances, the stop faces 76 of the cleats 70 on the lower side 68 of the clutch ring 64 and top of the spring cage 60 squarely abut one another, causing the clutch ring 64 to rotate with the spring cage 60 and spindle 18. However, the ramping surfaces 72 of the cleats 70 on the bottom of the driven gear 52 and the upper side of the clutch ring 64 are brought into contact with each other, forcing both the clutch ring 64 and the spring cage 60 to slide downwardly along the spindle 18. As the opposing lands 74 slide past one another, the spring 78 very positively forces the spring cage 60 together with the clutch ring 64 upwardly again, causing the upper side 66 of the clutch ring 64 to violently collide with the bottom of the driven gear 52. This collision results in a loud audible sound, repeated every quarter turn of the driven gear 52, which alerts of the need for remedial attention.

As an alternative to the loud audible sound caused by the clutch means 58 described above, a limit switch 84 may be positioned so that an electrical contact is made (or broken) whenever the spring cage 60 is forced downwardly by one set of the opposing cleats 70 riding over each other. The electrical signal caused by the limit switch 84 could cause a prerecorded message to be played, such as "Help, Help" or the like. Preferably, the limit switch 84 is mounted inside the guard 19.

The top cover 32 includes a pair of diametrically opposed electrical outlets 86 seated therein. The outlets 86 rotate with the spindle 18 and provide power to Christmas tree 24 (or other stemmed article) lighting and accessories. The outlets 86 each include a snap-fit connector comprising a pair of cantilever ears which attach within tower-like sockets 88 in the top cover 32. A pair of electrically insulated contact rings 90, 92 are embedded in the underside of the top cover 32. Each outlet 86 includes a pair of conductor tabs 94 which are splayed into surface engagement with the respective contact rings 90, 92 thereby establishing electrical connection without solder or mechanical fastening. A pair of spring loaded brushes 96, 98, shown in FIG. 4, are contained in an insulator 100, which in turn is housed in the base 12. The brushes 96, 98 respectively engage the contact rings 90, 92 to transmit electricity from the power cord 56 to the outlets 86.

Figure 10:
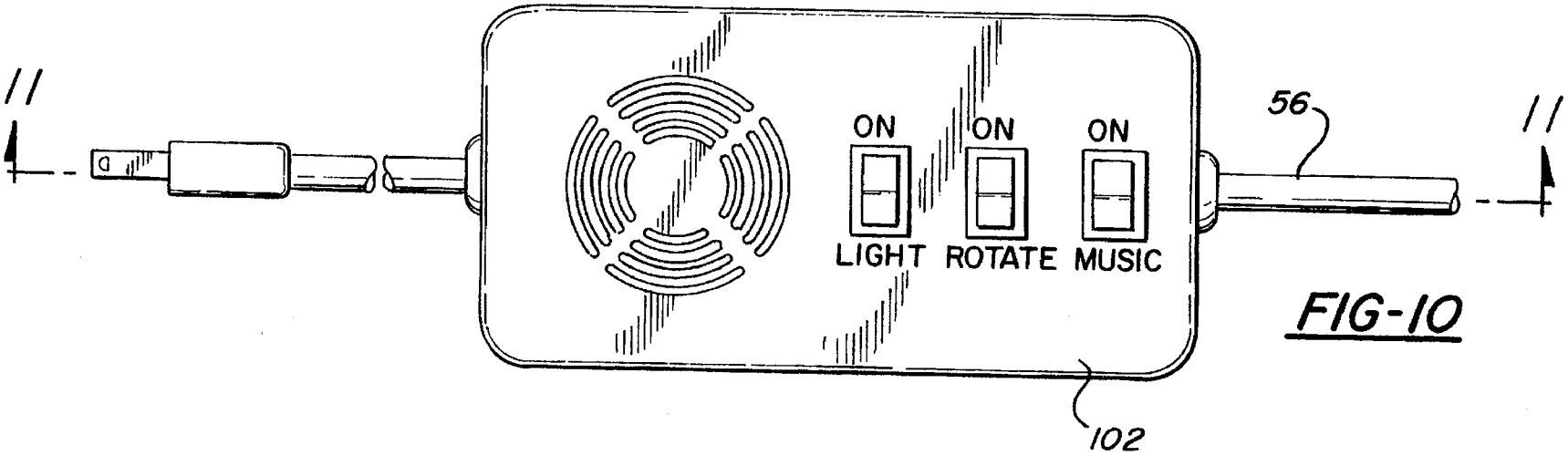
FIG. 10 is a side view of the control box showing internal electrical connections in hidden line.
Figure 11:
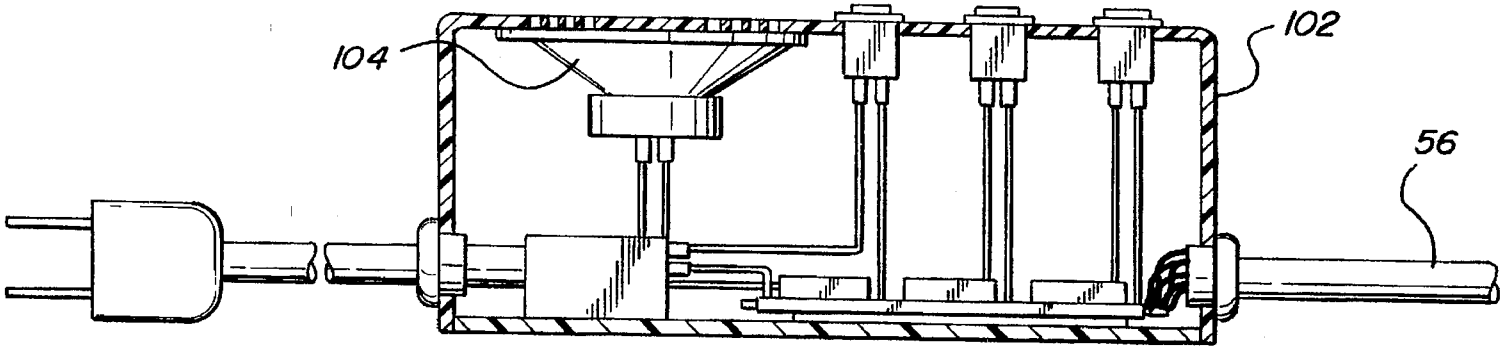
FIG. 11 is a top view of the control box.

A control box 102, shown in FIGS. 1, 10 and 11, is disposed along the power cord 56, exterior of the base 12, for providing a series of control functions. A music means is mounted inside the control box 102 for producing musical sounds, such as prerecorded Christmas music. The music means preferably comprises a loud speaker 104 and a computer chip with attendant circuitry to play the prerecorded sounds. A plurality of manual switches are positioned on the control box 102 for controlling electricity to the outlets 86, to the electric motor 46 and to the music means.

Figure 9:
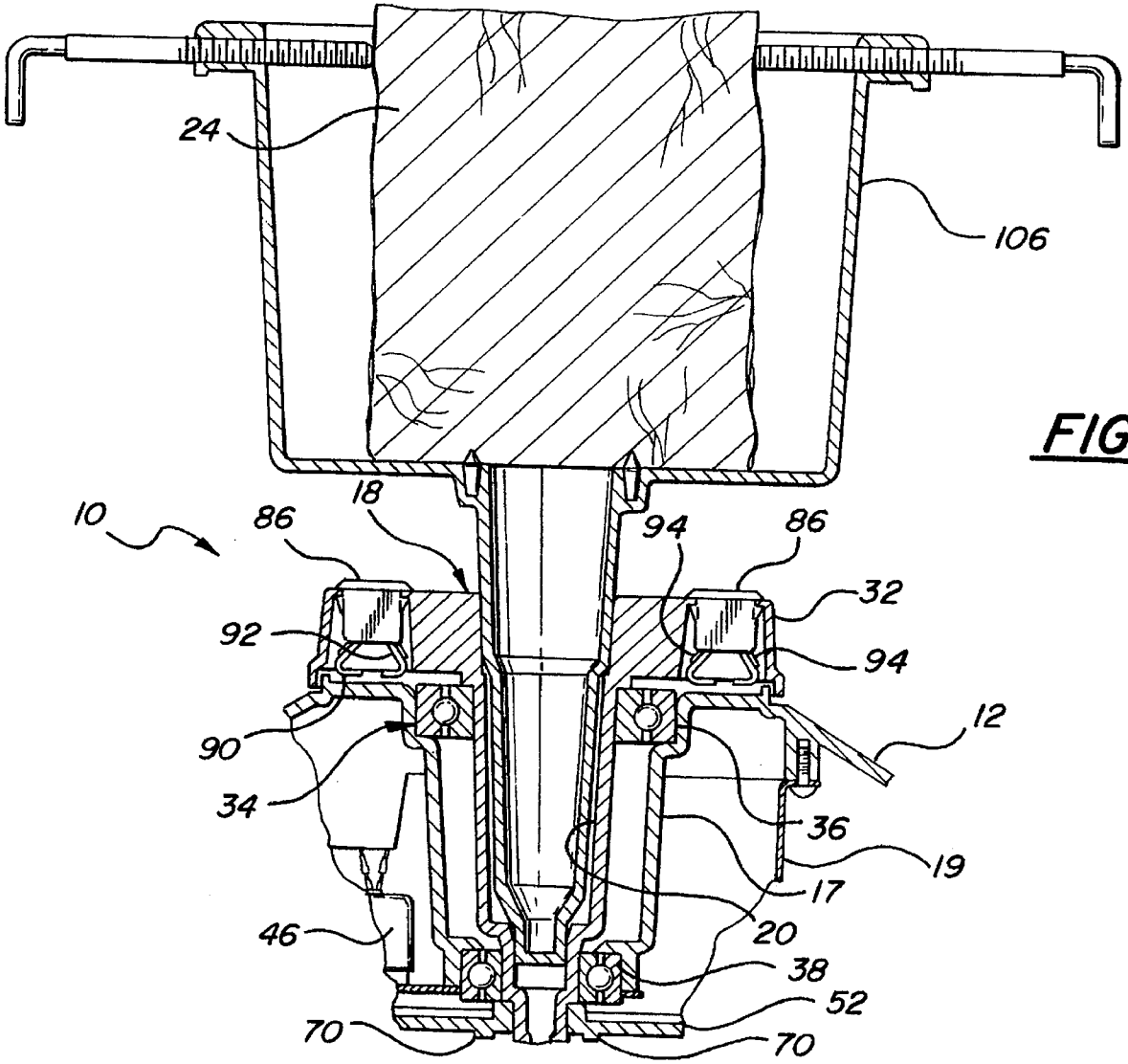
FIG. 9 is a cross-sectional view of an adapter for a live Christmas tree seated in the spindle receptacle.

Referring now to FIG. 9, an optional live tree adapter 106 is received into the receptacle 20. The live tree adapter 106 provides a large water reservoir to maintain freshness of the live tree 24. Stem fasteners thread through the side of the adapter 106 to hold the live tree upright. Spikes in the bottom of the adapter 106 prevent the tree 24 from slipping out of position.

The subject assembly 10 overcomes the disadvantages of the prior art in that the spring 78 in the clutch means 58 establishes and maintains a consistent point of disengagement for the clutch regardless of the weight of the tree 24 (or other stemmed article) and regardless of the frictional fit between the drive elements. In this manner, the subject assembly 10 is both durable and safe.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A rotating stand assembly (10) for a stemmed article such as a Christmas tree (24) or a merchandise display rack, said assembly (10) comprising:

a base (12);

a spindle (18) disposed within said base (12), said spindle (18) including a receptacle (20) for receiving and holding a stem in an upright posture;

bearing means (34) interconnecting said base (12) and said spindle (18) for rotatably supporting said spindle (18) relative to said base (12);

motor means (44) for forcibly rotating said spindle (18) within said base (12);

clutch means (58) for automatically disconnecting said motor from said spindle (18) in response to a predetermined force applied to said spindle (18);

and characterized by said clutch means (58) including spring means for establishing said predetermined force required to disconnect said motor means (44) from said spindle (18).

2. An assembly (10) as set forth in claim 1 wherein said clutch means (58) includes a spring cage (60) fixedly connected to said spindle (18).

3. An assembly (10) as set forth in claim 2 wherein said spindle (18) has a polygonal exterior cross section and said spring cage (60) has a polygonal hole mating with said spindle (18) to prevent rotation therebetween.

4. An assembly (10) as set forth in claim 2 wherein said motor means (44) includes a driver pinion (50).

5. An assembly (10) as set forth in claim 4 wherein said motor means (44) includes a driven gear (52) rotatably disposed about said spindle (18) and operatively engaging said driver pinion (50).

6. An assembly (10) as set forth in claim 5 wherein said clutch means (58) includes an intermediate clutch ring (64) rotatably disposed about said spindle (18) andoperatively engaging said driven gear (52).

7. An assembly (10) as set forth in claim 6 wherein said intermediate clutch ring (64) operatively engages said spring cage (60).

8. An assembly (10) as set forth in claim 7 wherein said clutch means (58) includes opposing cleats (70) between said driven gear (52) and said intermediate clutch ring (64).

9. An assembly (10) as set forth in claim 8 wherein said clutch means (58) includes opposing cleats (70) between said intermediate clutch ring (64) and said spring cage (60).

10. An assembly (10) as set forth in claim 9 further including a plurality of said cleats (70) disposed on each of said driven gear (52), said intermediate clutch ring (64) and said spring cage (60).

11. An assembly (10) as set forth in claim 10 wherein each of said cleats (70) includes a ramping surface (72), a land (74) and perpendicular stop face (76) for creating an audible report upon disengagement.

12. An assembly (10) as set forth in claim 11 wherein said spindle (18) rotates about a vertical central axis (A), and wherein said perpendicular stop face (76) of each of said cleats (70) is disposed in a plane radiating from said central axis (A).

13. An assembly (10) as set forth in claim 12 wherein said intermediate clutch ring (64) includes an upper side (66) adjacent said driven gear (52) and a lower side (68) adjacent said spring cage (60), said ramping surface (72) of each of said cleats (70) on said upper side (66) and on said lower side (68) of said clutch ring (64) extending from their respective said stop face (76) in a common direction.

14. An assembly (10) as set forth in claim 9 further including a retainer fixedly disposed on said spindle (18), said spring (78) reacting between said retainer and said spring cage (60).

15. An assembly (10) as set forth in claim 14 wherein said retainer comprises a nut (82) threaded on said spindle (18).

16. An assembly (10) as set forth in claim 9 wherein said spindle (18) includes a top cover (32) shielding an upper portion of said base (12).

17. An assembly (10) as set forth in claim 16 further including an electrical outlet (86) seated in said top cover (32).

18. An assembly (10) as set forth in claim 17 further including a pair of contact rings (90, 92) embedded in said top cover (32).

19. An assembly (10) as set forth in claim 18 wherein said outlet (86) includes a pair of conductor tabs (94) engaging said contact rings (90, 92).

20. An assembly (10) as set forth in claim 19 wherein said outlet (86) includes a snap-fit connector for attachment to said top cover (32).

21. An assembly (10) as set forth in claim 18 further including a pair of spring loaded brushes (96, 98) housed in base (12) and engaging said contact rings (90, 92).

22. An assembly (10) as set forth in claim 9 wherein said motor means (44) includes an electric motor (46), further including a power cord (56) extending from electric motor exteriorly of said base (12).

23. An assembly (10) as set forth in claim 22 further including a control box (102) disposed along power cord (56) and exterior of said base (12).

24. An assembly (10) as set forth in claim 23 further including music means in said control box (102) for producing musical sounds.

25. An assembly (10) as set forth in claim 24 wherein said control box (102) includes a plurality of manual switches for controlling electricity to said outlet (86), to said electric motor (46) and to said music means.

26. An assembly (10) as set forth in claim 9 further including a live tree adapter (106) received into receptacle (20), said live tree adapter (106) having a water reservoir and stem fasteners.

27. An assembly (10) as set forth in claim 9 further including a limit switch (84) responsive to disengagement of said clutch means (58).

* * * * *